US011580897B2

(12) United States Patent
Kim et al.

(10) Patent No.: US 11,580,897 B2
(45) **Date of Patent: *Feb. 14, 2023**

(54) PIXEL AND DISPLAY DEVICE INCLUDING THE SAME

(71) Applicant: SAMSUNG DISPLAY CO., LTD., Yongin-si (KR)

(72) Inventors: Na Young Kim, Yongin-si (KR); Dong Hwi Kim, Yongin-si (KR); Jin Jeon, Yongin-si (KR)

(73) Assignee: SAMSUNG DISPLAY CO., LTD., Yongin-si (KR)

( * ) Notice: Subject to any disclaimer, the term of this patent is extended or adjusted under 35 U.S.C. 154(b) by 0 days.

This patent is subject to a terminal disclaimer.

(21) Appl. No.: 17/526,086

(22) Filed: Nov. 15, 2021

(65) Prior Publication Data

US 2022/0076617 A1 Mar. 10, 2022

Related U.S. Application Data

(63) Continuation of application No. 17/021,346, filed on Sep. 15, 2020, now Pat. No. 11,176,874.

(30) Foreign Application Priority Data

Mar. 11, 2020 (KR) ..... 10-2020-0030205

(51) Int. Cl.
*G09G 3/32* (2016.01)

(52) U.S. Cl.
CPC ..... *G09G 3/32* (2013.01); *G09G 2310/027* (2013.01); *G09G 2310/0267* (2013.01); *G09G 2330/021* (2013.01)

(58) Field of Classification Search
CPC ..... G09G 2310/0267; G09G 2330/021; G09G 2310/027; G09G 3/32
See application file for complete search history.

(56) References Cited

U.S. PATENT DOCUMENTS 10,262,586 B2 4/2019 Lin et al.
2018/0293939 A1 10/2018 Kim et al.
(Continued)

FOREIGN PATENT DOCUMENTS

KR 10-2018-0114981 10/2018

OTHER PUBLICATIONS

Office Action dated Mar. 30, 2021 In Corresponding U.S. Appl. No. 17/021,346.

*Primary Examiner* — Muhammad N Edun
(74) *Attorney, Agent, or Firm* — F. Chau & Associates, LLC

(57) ABSTRACT

A display device includes: a pixel unit having a plurality of pixels; a timing controller supplying respective scan start signals to a plurality of scan drivers and an emission start signal to an emission driver, in response to synchronization signals supplied from the outside; the emission driver supplying an emission signal to emission control lines connected to the pixels based on the emission start signal; the scan drivers supplying scan signals to the scan lines connected to the pixels based on the scan start signal; and a data driver supplying a data signal to data lines connected to the pixels, and at least one of a frequency of the emission start signal and frequencies of the scan start signals may be a first frequency that is determined independently of a driving frequency when the driving frequency is less than or equal to a threshold value.

18 Claims, 11 Drawing Sheets

(56) References Cited

U.S. PATENT DOCUMENTS

| | | | |
|---|---|---|---|
| 2018/0322831 | A1 | 11/2018 | Kim et al. |
| 2019/0027093 | A1 | 1/2019 | Choi et al. |
| 2019/0057650 | A1 | 2/2019 | Choi et al. |
| 2020/0105198 | A1 | 4/2020 | Park et al. |
| 2021/0287599 | A1 | 9/2021 | Kim et al. |

PIXEL AND DISPLAY DEVICE INCLUDING THE SAME

CROSS-REFERENCE TO RELATED APPLICATIONS

This U.S. non-provisional patent application is a continuation of U.S. patent application Ser. No. 17/021,346 titled PIXEL AND DISPLAY DEVICE INCLUDING THE SAME and filed on Sep. 15, 2020; which, in turn, claims priority under 35 U.S.C. § 119 to Korean Patent Application No. 10-2020-0030205 filed in the Korean Intellectual Property Office on Mar. 11, 2020, the entire contents of which are incorporated by reference.

FIELD

The present invention relates to display devices, and more particularly, to a pixel and a display device including the same.

DISCUSSION OF RELATED ART

As information technology has developed, the importance of a display device, which provides a connection medium between a user and information, has been highlighted. Accordingly, the use of display devices such as a liquid crystal display device, an organic light-emitting display device, and a plasma display device has been increasing.

Each pixel of the display device may emit light with a luminance corresponding to a data voltage supplied through a data line. The display device may display an image frame by a combination of light emissions of pixels.

A plurality of pixels may be connected to each data line. A scan driver supplies a scan signal for selecting a pixel to which a data voltage is supplied among the pixels. The scan driver may have a form of a shift register to sequentially supply a scan signal of a turn-on level in units of a scan line.

Low-frequency driving for displaying a screen with a low driving frequency may be used in order to reduce power consumption of the display device. Due to a leakage characteristic of transistors constituting the pixels, light emission may not be achieved with desired luminance in low-frequency driving, and a flicker phenomenon may occur.

The above information disclosed in this section is only for enhancement of understanding, and therefore it may contain information that does not constitute prior art.

SUMMARY

Embodiments of the present invention may provide a display device capable of reducing power consumption through low-frequency driving by switching some of the transistors constituting pixels of the display device by a high-frequency signal and the other transistors by a low-frequency signal, and ensuring uniformity of a display screen as the transistors effectively operate even when driven by the low-frequency signal. The display device may provide a pixel recovery circuit. It shall be understood that the present invention is not limited to the above-described embodiments, and may be variously extended without departing from the spirit and scope of the present disclosure.

An exemplary embodiment of the present invention provides a display device. The display device may include a pixel unit having a plurality of pixels; a timing controller configured to supply respective scan start signals to a plurality of scan drivers and to supply an emission start signal to an emission driver, in response to synchronization signals supplied from the outside; the emission driver configured to supply an emission signal to emission control lines connected to the pixels based on the emission start signal; the scan drivers configured to supply scan signals to the scan lines connected to the pixels based on the scan start signal; and a data driver configured to supply a data signal to data lines connected to the pixels.

At least one of a frequency of the emission start signal and frequencies of the scan start signals may be a first frequency that is determined independently of a driving frequency when the driving frequency is a low frequency that is less than or equal to a threshold value. At least another of the frequency of the emission start signal and the frequencies of the scan start signals may be a second frequency that is the same as the driving frequency. The first frequency may be greater than the driving frequency.

Each of the pixels may include a driving transistor connected between a first power line and a third node to include a gate electrode connected to a first node; a first transistor between one of the data lines and a second node, and connected to a fourth scan line to receive a fourth scan signal; a second transistor connected between the first node and the third node to include a gate electrode connected to a third scan line to receive a third scan signal; a third transistor connected between the second node and an initialization line to include a gate electrode connected to one of the emission control lines to receive the emission signal; a fourth transistor connected between the third node and a fourth node to include a gate electrode connected to one of the emission control lines to receive the emission signal; a fifth transistor connected between the initialization line and the fourth node to include a gate electrode connected to a first scan line to receive a first scan signal; a sixth transistor connected between the first node and the initialization line to include a gate electrode connected to a second scan line to receive a second scan signal; a storage capacitor connected between the second node and the first node; and a light-emitting element connected between the fourth node and a second power line.

Each of the second transistor and the sixth transistor may be an oxide thin film transistor.

The first transistor may be the oxide thin film transistor.

A frequency of the emission signal and a frequency of the first scan signal may be the first frequency.

A frequency of the second scan signal, a frequency of the third scan signal, and a frequency of the fourth scan signal may be the second frequency.

Each of the pixels may repeat a first frame period at a time interval corresponding to the second frequency.

The first frame period may include a first period for initializing each of the pixels; a second period for compensating a threshold voltage of the driving transistor and writing the data signal to each of the pixels; and a third period during which the light-emitting element emits light with a luminance corresponding to the data signal.

In the first period, the first scan signal may be supplied to the first scan line, and the second scan signal may be supplied to the second scan line.

In the second period, the third scan signal may be supplied to the third scan line, and the fourth scan signal may be supplied to the fourth scan line.

In the third period, the emission signal may be supplied to one of the emission control lines.

Each of the pixels may repeat a second frame period at a time interval corresponding to the first frequency.

The second frame period may include the third period and the fourth period for initializing a first electrode of the light-emitting element.

In the fourth period, the first scan signal may be supplied to the first scan line.

Each of the second transistor and the sixth transistor may be a dual-gate transistor including an active layer pattern, a top gate electrode disposed at an upper portion of the active layer pattern, and a bottom gate electrode disposed at a lower portion of the active layer pattern.

The first frequency may be a maximum driving frequency of the display device.

Each of the first transistor, the third transistor, the fourth transistor, and the fifth transistor may be a P-type transistor, and each of the second transistor and the sixth transistor may be an N-type transistor.

Each of the first transistor, the second transistor, and the sixth transistor may be an N-type transistor, and each of the third transistor, the fourth transistor, and the fifth transistor are P-type transistors.

The first transistor may include a gate electrode connected to the third scan line instead of the fourth scan line to receive the third scan signal.

An exemplary embodiment of the present invention provides a pixel of a display device.

The pixel of the display device may include a driving transistor connected between a first power line and a third node and including a gate electrode connected to a first node; a first transistor connected between a data line and a second node and including gate electrode connected to a fourth scan line to receive a fourth scan signal; a second transistor connected between the first node and the third node and including a gate electrode connected to a third scan line to receive a third scan signal; a third transistor connected between the second node and an initialization line and including a gate electrode connected to an emission control line to receive an emission signal; a fourth transistor connected between the third node and a fourth node and including a gate electrode connected to the emission control line to receive the emission signal; a fifth transistor connected between the initialization line and the fourth and including a gate electrode connected to a first scan line to receive a first scan signal; a sixth transistor connected between the first node and the initialization line and including a gate electrode connected to a second scan line to receive a second scan signal; a storage capacitor connected between the second node and the first node; and a light-emitting element connected between the fourth node and a second power line.

At least one of a frequency of the emission signal, a frequency of the first scan signal, a frequency of the second scan signal, a frequency of the third scan signal, and a frequency of the fourth scan signal may be a first frequency that is determined independently of a driving frequency when the driving frequency is a low frequency that is less than or equal to a threshold value.

At least another of the frequency of the emission signal, the frequency of the first scan signal, the frequency of the second scan signal, the frequency of the third scan signal, and the frequency of the fourth scan signal may be a second frequency that is the same as the driving frequency.

Each of the second transistor and the sixth transistor may be an oxide thin film transistor.

In accordance with the pixel and the display device including the same, it is possible to effectively maintain a desired luminance during low-frequency driving by configuring some transistors in the pixel as an oxide thin film transistor, and thus it has strong characteristics against flicker.

In addition, scan signals for switching some of the transistors constituting a pixel may be supplied at a low frequency, and scan signals and emission control signals for switching the other transistors may be supplied at a high frequency, thereby preventing uniformity of an image from being reduced due to low frequency driving and effectively reducing power consumption.

In addition, by configuring some of the transistors constituting the pixel as a dual gate transistor, a light blocking effect may be obtained, and the turn-on response speed of the transistor may be improved.

Each of the second transistor and/or the sixth transistor may be a dual-gate transistor. The first frequency is greater than the threshold value.

An exemplary embodiment of the present invention provides a display panel having: an array of pixels arranged in plurality of rows and a plurality of columns; a column driver connected to each of the plurality of columns; and a plurality of row drivers, each connected to each of the plurality of rows, wherein a first row driver of the plurality of row drivers has a variable output frequency equal to a variable display panel driving frequency, wherein a second row driver of the plurality of row drivers has a variable output frequency equal to the variable display panel driving frequency when that frequency is greater thana threshold frequency, or greater than the threshold frequency when the variable display panel driving frequency is less than the threshold frequency.

Each pixel may include a first plurality of transistors having gates connected to the first row driver; and a second plurality of transistors having gates connected to the second row driver. At least one of the first plurality of transistors may be connected to the column driver, and/or at least one of the second plurality of transistors is connected to a light-emitting element.

DETAILED DESCRIPTION

Figure 1:
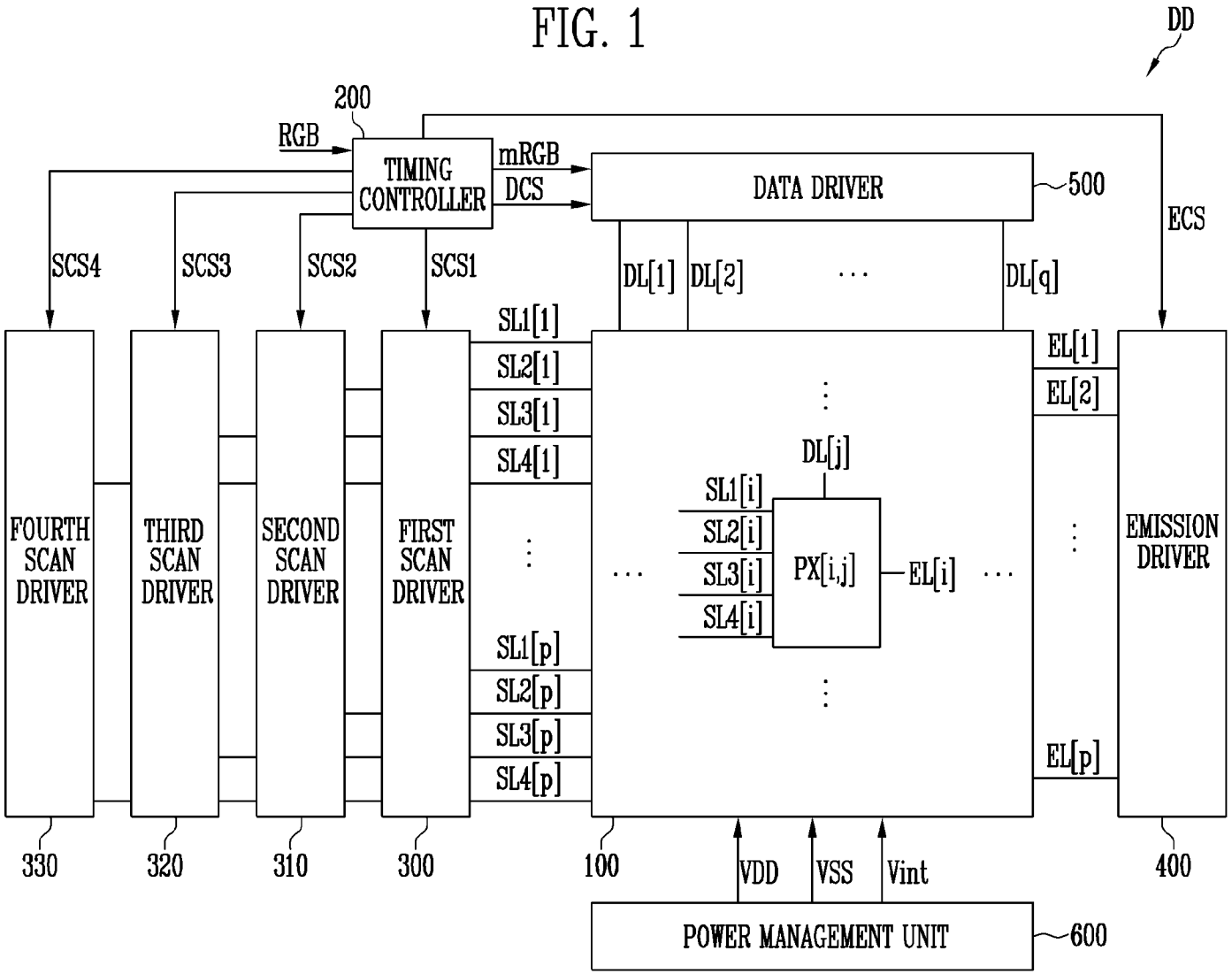
FIG. 1 is a schematic block diagram illustrating a display device according to an exemplary embodiment of the present invention.

The present invention will be described more fully hereinafter by way of example with reference to the accompanying drawings, in which exemplary embodiments of the invention are shown. As those skilled in the art would realize, the described embodiments may be modified in various different ways without departing from the spirit or scope of the present invention.

To clearly describe the present invention, parts that are irrelevant to the description may be omitted, and like reference numerals may refer to like or similar constituent elements throughout the specification. Therefore, the reference numerals described herein may be used in one or more of the drawings.

Further, since sizes and thicknesses of constituent members shown in the accompanying drawings are arbitrarily given for better understanding and ease of description, the present invention is not limited to the illustrated sizes and thicknesses. In the drawings, the thickness of layers, films, panels, regions, etc., are exaggerated for clarity.

FIG. 1 illustrates a display device according to an exemplary embodiment of the present invention.

Referring to FIG. 1, a display device DD includes a pixel unit 100, a timing controller 200, a first scan driver 300, a second scan driver 310, a third scan driver 320, and a fourth scan driver 330, an emission driver 400, a data driver 500, and/or a power management unit 600.

The pixel unit 100 may include a plurality of pixels PX[i, j]. The pixels PX[i, j] may include p rows (p being a natural number of 1 or more) and q columns (q being a natural number of 1 or more). The pixels PX[i, j] disposed in a same row (hereinafter, may be referred to as a mixture of horizontal lines) include a same first scan line, a same second scan line, a same third scan line, and a same fourth scan line, and a same emission control line. In addition, the pixels PX[i, j] disposed in a same column (hereinafter, may be referred to as a mixture of vertical lines) may be connected to a same data line. For example, the pixel PX[i, j] disposed in an $i^{th}$ row (i being a natural number less than or equal to p) and a $j^{th}$ (j being a natural number less than or equal to q) may be connected to an $i^{th}$ first scan line SL1[i]), an $i^{th}$ second scan line SL2[i], an $i^{th}$ third scan line SL3[i], an $i^{th}$ fourth scan line SL4[i], an $i^{th}$ emission control line, and an $j^{th}$ data line DL[j]).

The timing controller 200 may generate a first scan control signal SCS1, a second scan control signal SCS2, a third scan control signal SCS3, a fourth scan control signal SCS4, an emission control signal ECS, and a data control signal DCS in response to synchronization signals supplied from the outside.

The first scan control signal SCS1 may be supplied to the first scan driver 300, the second scan control signal SCS2 may be supplied to the second scan driver 310, the third scan control signal SCS3 may be supplied to the third scan driver 320, the fourth scan control signal SCS4 may be supplied to the fourth scan driver 330, the emission control signal ECS may be supplied to the emission driver 400, and the data control signal DCS may be supplied to the data driver 500.

The first scan control signal SCS1 may include a first scan start signal and clock signals. The first scan start signal may be a signal for controlling first timing of the first scan signals. The clock signals may be used to shift the first scan start signal.

The second scan control signal SCS2 may include a second scan start signal and clock signals. The second scan start signal may be a signal for controlling first timing of the second scan signals. The clock signals may be used to shift the second scan start signal.

The third scan control signal SCS3 may include a third scan start signal and clock signals. The third scan start signal may be a signal for controlling first timing of the third scan signals. The clock signals may be used to shift the third scan start signal.

The fourth scan control signal SCS4 may include a fourth scan start signal and clock signals. The fourth scan start signal may be a signal for controlling first timing of the fourth scan signals. The clock signals may be used to shift the fourth scan start signal.

The emission control signal ECS may include an emission start signal and clock signals. The emission start signal may be a signal for controlling first timing of the emission signal. The clock signals may be used to shift the emission start signal.

A frequency of the emission start signal may be constant regardless of a change in a driving frequency of the display device DD. For example, the frequency of the emission start signal may be 120 Hz when the display device DD operates at a driving frequency of 120 Hz (that is, high-frequency operation), and may also be 120 Hz even when the display device DD operates at a driving frequency of 1 Hz (low-frequency operation). In other words, the frequency of the emission start signal may be a first frequency f1 (see FIG. 7) independently determined from a driving frequency when the driving frequency of the display device DD is a low frequency that is less than or equal to a threshold value. For example, the frequency of the emitting start signal may be a maximum driving frequency of the display device DD.

A frequency of the first scan start signal may be constant regardless of a change in the driving frequency of the display device DD. For example, the frequency of the first scan start signal may be 120 Hz when the display device DD operates at a driving frequency of 120 Hz (that is, high-frequency operation), and may also be 120 Hz even when the display device DD operates at a driving frequency of 1 Hz (low-frequency operation). In other words, the frequency of the first scan start signal may be a first frequency f1 (see FIG. 7) determined independently of a driving frequency when the driving frequency of the display device DD is a low frequency. For example, the frequency of the first scan start signal may be the maximum driving frequency of the display device DD.

Frequencies of the second scan start signal, the third scan start signal, and the fourth scan start signal may vary according to a change in the driving frequency of the display device DD. For example, the frequencies of the second scan start signal, the third scan start signal, and the fourth scan start signal may be 120 Hz when the display device DD operates at a driving frequency of 120 Hz (that is, high-frequency operation), and may be frequencies between 120 Hz and 1 Hz when the display device DD operates at a driving frequency of 1 Hz (low-frequency operation). In other words, the frequencies of the second scan start signal, the third scan start signal, and the fourth scan start signal may vary according to a change in the driving frequency of the display device DD.

The data control signal DCS may include source start pulse and clock signals. The source start pulse may control a sampling starting point of data. The clock signals may be used to control a sampling operation.

The timing controller 200 may receive input image data RGB from the outside, may rearrange the input image data RGB, may generate image data mRGB, and may supply the image data mRGB to the data driver 500. The input image data RGB may include at least one image frame. In an exemplary embodiment, at least one image frame may indicate a red grayscale value R, a green grayscale value G, and/or a blue grayscale value B for each unit dot. Each unit dot may correspond to one pixel, but when the pixel unit 100 has a PenTile® structure, some of adjacent pixels (e.g., some subpixels included in the pixel) may be shared, and thus the unit dot may not correspond to one pixel.

The first scan driver 300 may receive the first scan control signal SCS1 from the timing controller 200, and may sequentially supply first scan signals to the first scan lines SL1[1], . . . , SL1[i], . . . , SL1[p] based on the first scan control signal SCS1. For example, the first scan driver 300 may generate first scan signals while shifting the first scan start signal by a horizontal period 1 H, and a frequency of the first scan signals may be the same as a frequency of the first scan start signal.

The second scan driver 310 may receive the second scan control signal SCS2 from the timing controller 200, and may sequentially supply second scan signals to the second scan lines SL2[1], . . . , SL2[i], . . . , and SL2[p] based on the second scan control signal SCS2. For example, the second scan driver 310 may generate second scan signals while shifting the second scan start signal by a horizontal period 1 H, and a frequency of the second scan signals may be the same as a frequency of the second scan start signal.

The third scan driver 320 may receive the third scan control signal SCS3 from the timing controller 200, and may sequentially supply third scan signals to the third scan lines SL3[1], . . . , SL3[i], . . . , and SL3[p] based on the third scan control signal SCS3. For example, the third scan driver 320 may generate third scan signals while shifting the third scan start signal by a horizontal period 1 H, and a frequency of the third scan signals may be the same as a frequency of the third scan start signal.

The fourth scan driver 330 may receive the fourth scan control signal SCS3 from the timing controller 200, and may sequentially supply fourth scan signals to the fourth scan lines SL4[1], . . . , SL4[i], . . . , and SL4[p] based on the fourth scan control signal SCS4. For example, the fourth scan driver 330 may generate fourth scan signals while shifting the fourth scan start signal by a horizontal period 1 H, and a frequency of the fourth scan signals may be the same as a frequency of the fourth scan start signal.

The emission driver 400 may receive the emission control signal ECS from the timing controller 200, and may sequentially supply emission signals to the emission control lines EL[1], . . . , EL[i], . . . , and EL[p] based on the emission control signal ECS. For example, the emission driver 400 may generate light emission signals while shifting the light emission start signal by a horizontal period 1 H, and a frequency of the emission signals may be the same as a frequency of the emission start signal. When the emission signals are sequentially supplied, the pixels PX[i, j] to which the emission signals are supplied may emit light with a luminance corresponding to the data signal.

The data driver 500 may receive the data control signals DCS and the image data mRGB from the timing controller 200. The data driver 500 may supply data signals, such as data voltages, corresponding to the image data mRGB into the data lines DL[1], DL[2], . . . , DL[j], . . . , and DL[q].

For example, the data driver 500 may supply the data signals to the pixels PX[i, j] disposed on a horizontal line selected by the first scan signals, the second scan signals, the third scan signals and/or the fourth scan signals. More specifically, the data driver 500 may supply the data signals to the pixels PX[i, j] disposed on a horizontal line selected by the fourth scan signals. The data driver 500 may supply the data signals to be synchronized with the first scan signals, the second scan signals, the third scan signals, and/or the fourth scan signals. More specifically, the data driver 500 may supply the data signals to be synchronized with the fourth scan signals.

The power management unit 600 may supply the first power voltage VDD, the second power voltage VSS, and the initialization voltage Vint to each pixel PX[i, j] included in the pixel unit 100. In this case, a first power supply line VDDL (see FIG. 2) to which the first power supply voltage VDD is supplied, a second power supply line VSSL (see FIG. 2) to which the second power supply voltage VSS is supplied, and an initialization line VintL (see FIG. 2) to which the initialization voltage Vint is supplied, may be connected to each pixel PX[i, j]. The first power line VDDL, the second power line VSSL, and the initialization line VintL may be commonly connected to some or all of the pixels.

The first power voltage VDD and the second power voltage VSS may be voltages for driving the emission elements included in each pixel PX[i, j] of the pixel unit 100. In an exemplary embodiment, the second power voltage VSS may be lower than the first power voltage VDD. For example, the first power voltage VDD may be a positive voltage, and the second power voltage VSS may be a negative voltage.

The pixel unit 100 may be disposed in the display area of the display panel, and at least one of the controller 200, the first to fourth scan drivers 300, 310, 320, and 330, the light emission driver 400, the data driving unit 500, and the power management unit 600 may be disposed in the non-display area of the display panel.

Meanwhile, at least some of the first scan driver 300, the second scan driver 310, the third scan driver 320, and the fourth scan driver 330 may be integrated into a single unit. For example, the second scan driver 310 and the third scan driver 320 may be integrated into the third scan driver 320, and the second scan signal outputted from the second scan driver 310 may be replaced by the third scan signal of a previous horizontal line outputted from the third scan driver 320. Specifically, for example, the third scan signal outputted from the i-k$^{th}$ third scan line SL3[i-k] (k being a natural number greater than or equal to 1 and less than i) may be used as the second scan signal outputted from the i$^{th}$ second scan line SL2[i].

Figure 2:
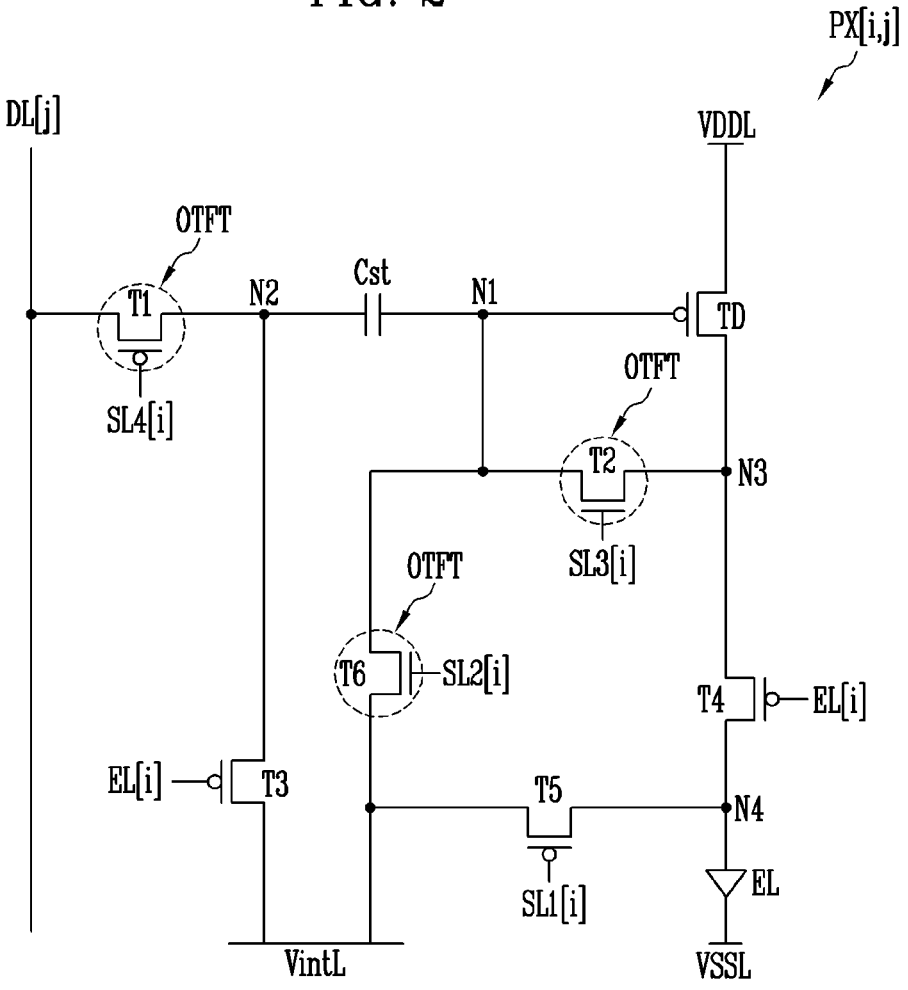
FIG. 2 is a circuit diagram illustrating a pixel of the display device according to FIG. 1.

FIG. 2 illustrates a pixel of the display device according to FIG. 1.

Although the pixel PX[i, j] disposed in the i$^{th}$ row and the j$^{th}$ column is described as an example in FIG. 2, other pixels may be configured substantially identically.

Referring to FIG. 2, the pixel PX[i, j] includes a plurality of transistors TD, T1, T2, T3, T4, T5, and T6, a storage capacitor Cst, and an emission element EL.

The driving transistor TD may be connected between the first power line VDDL and a third node N3 and include a gate electrode connected to a first node N1. The driving transistor TD may be turned on by a voltage applied to the first node N1 to generate a driving current and to supply the generated driving current to the emission element EL electrically connected to a fourth node N4.

The first transistor T1 may be connected between the data line DL[j] and a second node N2 and include a gate electrode connected to the fourth scan line SL4[i]. The first transistor T1 may be turned on by the fourth scan signal supplied through the fourth scan line SL4[i] and to supply the data signal, such as a data voltage, to the second node N2 through the data line DL[j].

The second transistor T2 may be connected between the first node N1 and the third node N3 and include a gate electrode connected to the third scan line SL3[i]. The second transistor T2 may be turned on by the third scan signal supplied through the third scan line Sl3[i] to electrically connect the first node N1 and the third node N3. That is, the second transistor T2 may allow the driving transistor TD to operate as a diode by electrically connecting the gate electrode (or first node N1) of the driving transistor TD and the second electrode (or third node N3) of the driving transistor TD.

The third transistor T3 may be connected between the second node N2 and the initialization line VintL and include a gate electrode connected to the emission control line EL[i]. The third transistor T3 may be turned on by the emission signal supplied through the light emission control line El[i] to apply the initialization voltage Vint to the second node N2.

The fourth transistor T4 may be connected between the third node N3 and the fourth node N4 and include a gate electrode connected to the emission control line EL[i]. The fourth transistor T4 may be turned on by the emission signal supplied through the emission control line EL[i] to electrically connect the third node N3 and the fourth node N4. That is, when the fourth transistor T4 is turned on, a driving current of the driving transistor TD may be transferred to the first electrode (or fourth node N4) of the emission element EL.

The fifth transistor T5 may be connected between the initialization line VintL and the fourth node N4 and include a gate electrode connected to the first scan line SL1[i]. The fifth transistor T5 is turned on by the first scan signal supplied through the first scan line SL1[i] to apply the initialization voltage Vint to the fourth node N4. That is, when the fifth transistor T5 is turned on, the first electrode (or the fourth node N4) of the emission element EL may be initialized into the initialization voltage Vint.

The sixth transistor T6 may be connected between the first node N1 and the initialization line VintL and include a gate electrode connected to the second scan line SL2[i]. The sixth transistor T6 is turned on by the second scan signal supplied through the second scan line SL2[i] to apply the initialization voltage Vint to the first node N1.

The storage capacitor Cst may be connected between the second node N2 and the first node N1 to store a voltage corresponding to a data signal applied to the second node N2. For example, the storage capacitor Cst may store a difference voltage between a voltage of the data signal applied to the second node N2 and a voltage of the first node N1.

The emission element EL may be connected between the fourth node N4 and the second power line VSSL, and may receive a driving current through the fourth node N4. For example, an anode (or the first electrode) of the emission element EL may be connected to the fourth node N4, and a cathode (or the second electrode) of the emission element EL may be connected to the second power line VSSL.

In FIG. 2, the first transistor T1, the third transistor T3, the fourth transistor T4, and the fifth transistor T5 are illustrated as p-type transistors, and the second transistor T2 and the sixth transistor T6 is illustrated as an n-type transistor, but any of the n-type transistors may be changed to a p-type transistor, and/or any of the p-type transistors may be changed to an n-type transistor, and adapted such as by changing a polarity of the voltage applied to the gate electrode.

In an exemplary embodiment, the p-type transistor may include a polysilicon semiconductor layer formed through a low temperature poly-silicon (LTPS) process as an active layer (channel). Since the p-type transistor including the polysilicon semiconductor layer may have a relatively fast response speed, the p-type transistor may be applied to a switching element requiring fast switching (e.g., the first transistor T1, the third transistor T3, the fourth transistor T4, and/or the fifth transistor T5 in FIG. 2).

On the other hand, when the display device DD is driven at a low frequency, the second transistor T2 and the sixth transistor T6, which are n-type transistors, may have poor leakage characteristics, so that the voltage of the gate electrode of the driving transistor TD connected to the first node N1 may fluctuate. When the voltage of the gate electrode of the driving transistor TD fluctuates, the driving current may be changed, so that the light-emitting element EL may not emit light with a desired luminance, and a flicker phenomenon may occur.

According to an exemplary embodiment of the present invention, the second transistor T2 and the sixth transistor T6 may be oxide thin film transistors (Oxide TFT, OTFT). The oxide thin film transistor OTFT may include an oxide semiconductor layer formed on a substrate of the display panel included in the display device DD or a buffer layer on the substrate, a gate insulating film formed on the oxide semiconductor, and a gate electrode formed on the gate insulating film. The oxide semiconductor layer may form an active layer (channel) of the oxide thin film transistor OTFT. The oxide semiconductor layer may be made of a material selected from the group including indium, gallium, zinc, and oxygen. For example, the oxide semiconductor layer may be an IGZO in which indium, gallium, zinc, and oxygen are combined.

Additionally, the first transistor T1 may also be an oxide thin film transistor OTFT.

That is, where the first transistor T1, the second transistor T2, and/or the sixth transistor T6 are each implemented as an oxide thin film transistor OTFT, a leakage characteristic may be improved (i.e., current leakage may be minimized) and a flicker phenomenon may be prevented.

Hereinafter, when the emission signal supplied through the emission control line EL[i] is at a low level (gate turn-on level), the emission signal is expressed as 'supplied'; when the first scan signal supplied through the first scan line SL1[i] is at a low level (gate turn-on level), the first scan signal is expressed as 'supplied'; when the second scan signal supplied through the second scan line SL2[i] is at a high level (gate turn-on level), the second scan signal is expressed as 'supplied'; when the third scan signal supplied through the third scan line SL3[i] is at a high level (gate turn-on level), the third scan signal is expressed as 'supplied'; and when the fourth scan signal supplied through the fourth scan line SL4[i] is at a low level (gate turn-on level), the fourth scan signal is expressed as 'supplied'.

Figure 3:
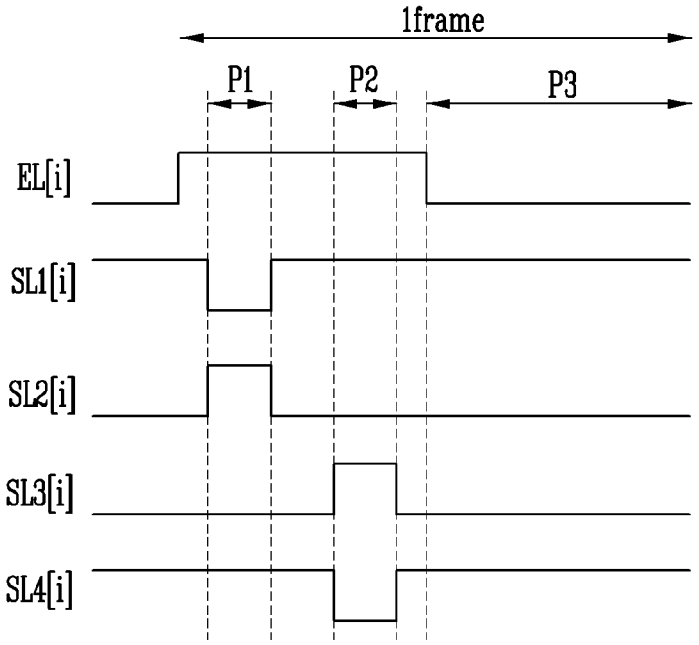
FIG. 3 is a graphical waveform diagram for describing an operation of the pixel according to FIG. 2.
Figure 4:
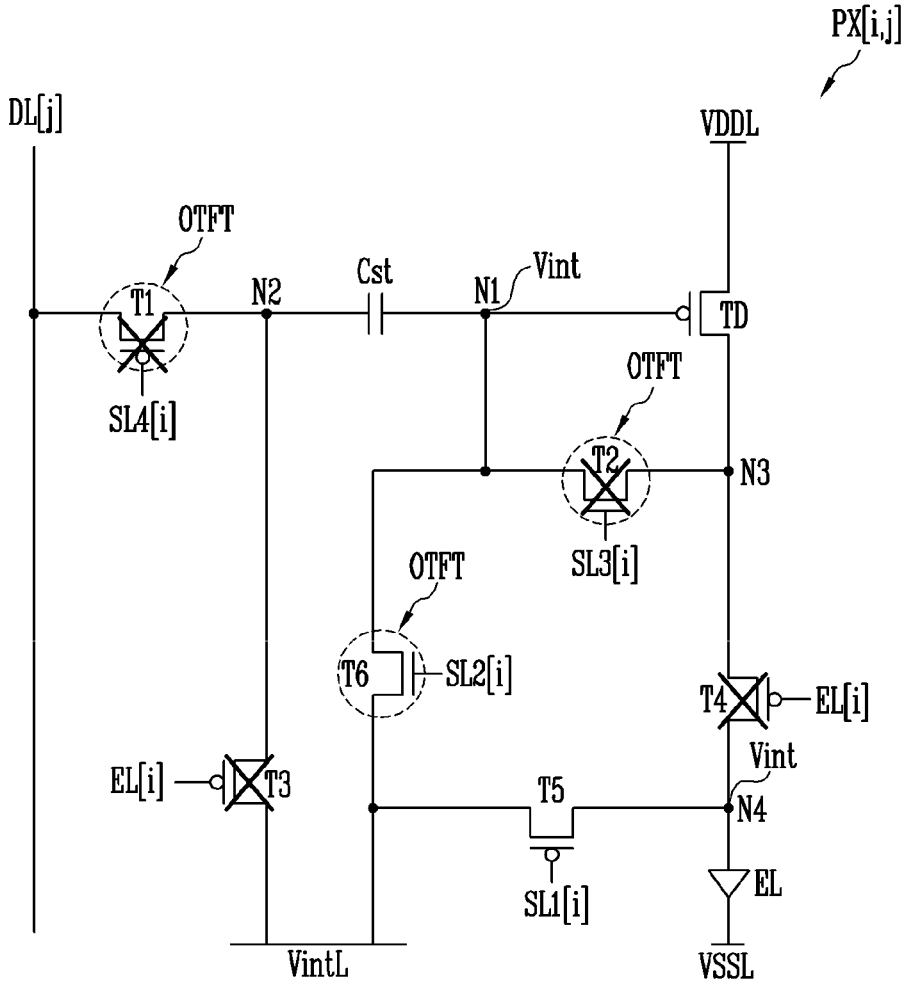
FIG. 4 is a circuit diagram illustrating a pixel according to a first period of FIG. 3.
Figure 5:
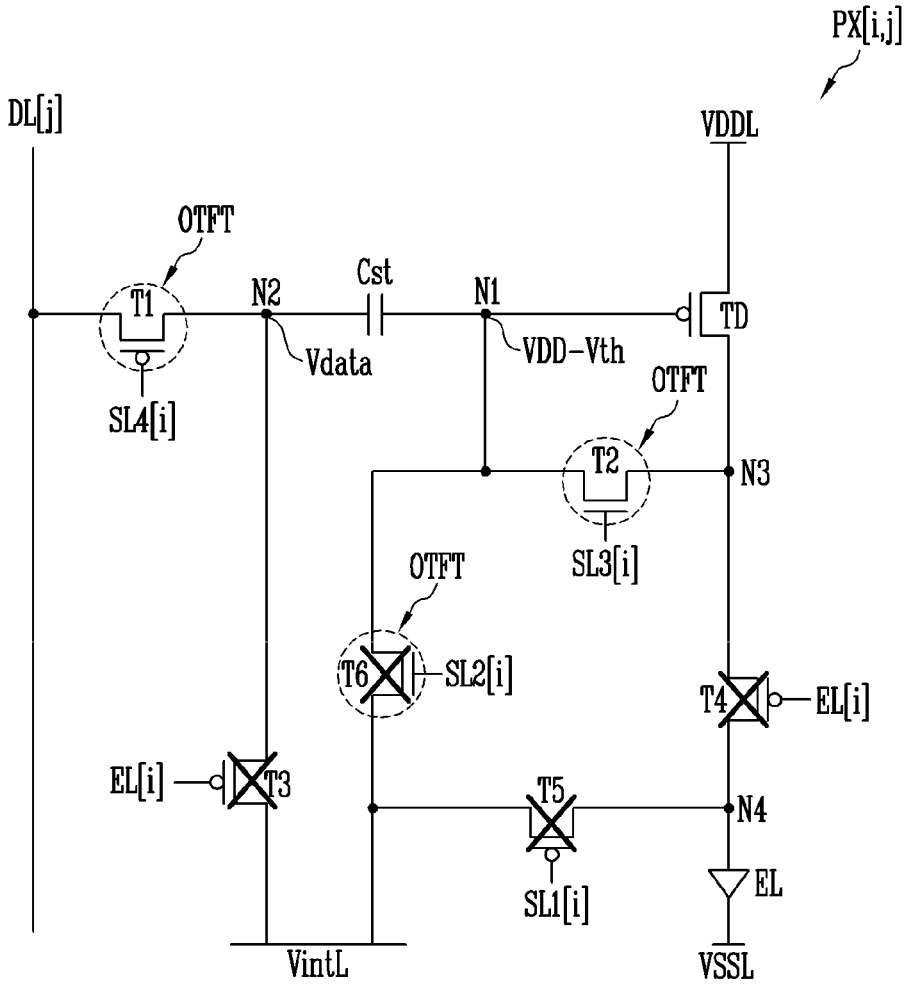
FIG. 5 is a circuit diagram illustrating a pixel according to a second period of FIG. 3.
Figure 6:
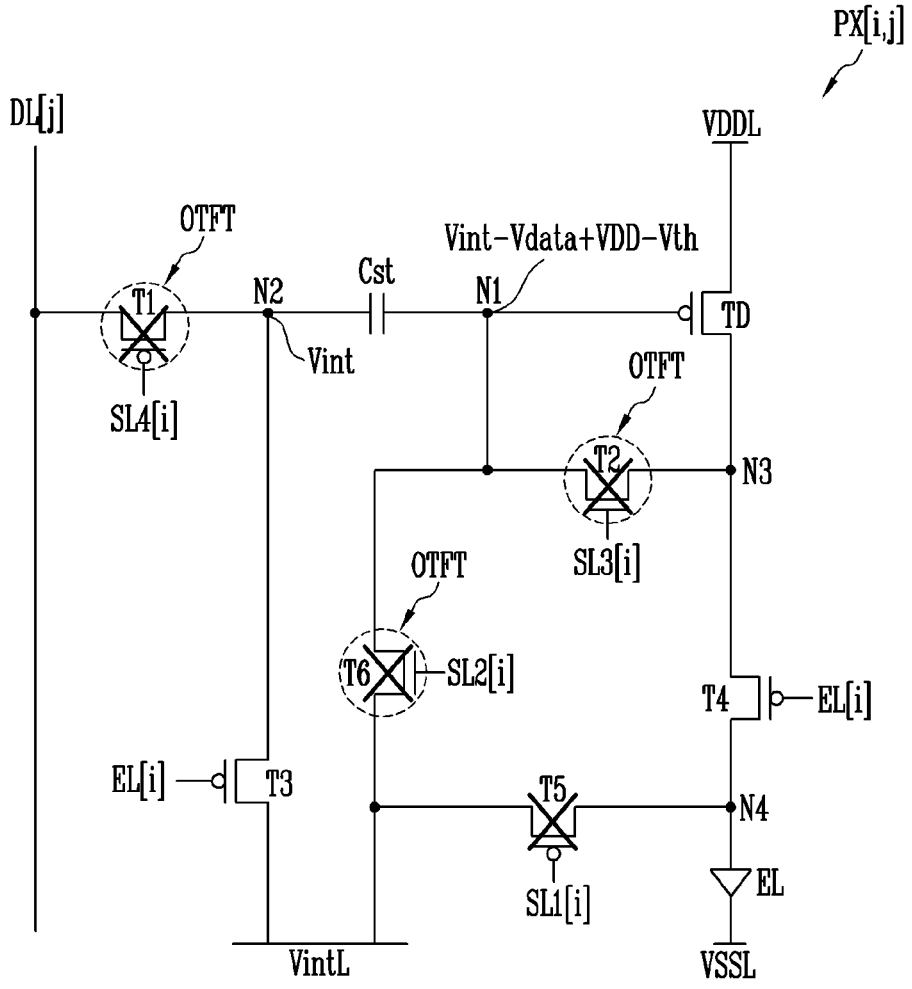
FIG. 6 is a circuit diagram illustrating a pixel according to a third period of FIG. 3.

FIG. 3 illustrates a waveform diagram for describing an operation of the pixel according to FIG. 2. FIG. 4 illustrates a pixel according to a first period of FIG. 3. FIG. 5 illustrates a pixel according to a second period of FIG. 3. FIG. 6 illustrates a pixel according to a third period of FIG. 3.

Referring to FIG. 3, when the pixel PX[i, j] according to FIG. 2 operates during a first frame period 1frame, waveforms of the emission signal supplied through the emission control line EL[i] and the first to fourth scan signals supplied through the first to fourth scan lines SL1[i], SL2[i]), SL3[i]), and Sl4[i] nay be checked.

The first frame period 1frame may include a first period P1 for initializing PX[i, j], a second period P2 for compensating a threshold voltage of the driving transistor TD and writing the data signal to the pixel PX[i, j] after the first period P1, and a third period P3 for emitting light with luminance corresponding to the data signal after the second period P2.

In the first period P1, a first scan signal of a low level may be supplied to the pixel PX[i, j] through the first scan line Sl1[i], and a second scan signal of a high level may be supplied to the pixel PX[i, j] through the second scan line SL2[i]. Accordingly, referring to FIG. 4, the fifth transistor T5 and the sixth transistor T6 may be turned on, and the first to fourth transistors T1 to T4 may be turned off. When the fifth transistor T5 is turned on, the initialization voltage Vint may be applied to the fourth node N4. Accordingly, the first electrode (or anode) of the emission element EL may be initialized with the initialization voltage Vint. When the sixth transistor T6 is turned on, the initialization voltage Vint may be applied to the first node N1. Accordingly, the gate electrode of the driving transistor TD may be initialized with the initialization voltage Vint.

In the second period P2, a third scan signal of a high level may be supplied to the pixel PX[i, j] through the third scan line SL3[i], and a fourth scan signal of a low level may be supplied to the pixel PX[i, j] through the fourth scan line SL4[i]. Accordingly, referring to FIG. 5, the first transistor T1 and the second transistor T2 may be turned on, and the third to sixth transistors T3 to T6 may be turned off. When the first transistor T1 is turned on, the data signal supplied through the data line DL[j] may be transferred to the second node N2. In addition, when the second transistor T2 is turned on, the driving transistor TD operates in a diode form, and thus a voltage VDD-Vth that is lower than the first power voltage VDD by a threshold voltage Vth of the driving transistor TD may be applied to the third node N3, and the voltage VDD-Vth applied to the third node N3 may be applied to the first node N1 through the second transistor T2. Accordingly, the storage capacitor Cst may store (or charge) a differential voltage Vdata-VDD+Vth between a voltage Vdata of the data signal transferred to the second node N2 and a voltage VDD-Vth applied to the third node N3.

In the third period P3, an emission signal of a low level may be supplied to the pixel PX[i, j] through the emission control line EL[i]. Accordingly, referring to FIG. 6, the third transistor T3 and the fourth transistor T4 may be turned on, and the first transistor T1, the second transistor T2, the fifth transistor T5, and the sixth transistor T6 may be turned off. When the third transistor T3 is turned on, the initialization voltage Vint may be applied to the second node N2. Accordingly, a differential voltage between the initialization voltage Vint and the voltage stored in the storage capacitor Cst may be applied to the first node N1. For example, the voltage stored in the storage capacitor Cst may be the voltage Vdata-VDD+Vth stored in the second period P2, and a differential voltage Vint-Vdata+VDD-Vth between the initialization voltage Vint and the voltage Vdata-VDD+Vth stored in the storage capacitor Cst may be applied to the first node N1.

When the differential voltage is applied to the first node N1, the driving transistor TD may generate a driving current corresponding to the differential voltage applied to the first node N1 to transfer the driving current to the fourth transistor T4. The fourth transistor T4 may be turned on by the emission signal of the low level to transfer the driving current received from the driving transistor TD to the emission element EL, and the emission element EL may emit light with a luminance corresponding to the driving current.

When a driving frequency of the display device DD is a high frequency (e.g., 60 Hz or more), the first frame period 1frame illustrated in FIG. 3 may be repeatedly performed in accordance with the driving frequency. For example, when the driving frequency of the display device DD is 120 Hz, the first period P1, the second period P2, and the third period P3 included in the first frame period 1frame may be repeated 120 times per second. That is, the first scan signals to the fourth scan signals supplied through the first scan line to the fourth scan line, and the emission signals supplied through the emission control line, may have a same frequency as the driving frequency.

When the driving frequency of the display device DD is a low frequency (e.g., 10 Hz, 1 Hz, etc.), the power consumption of the display device DD may be reduced, and thus low-frequency driving may be used. However, when the display device DD is driven at a low frequency, a flicker phenomenon may occur. For example, when the driving frequency of the display device DD is 1 Hz, the flicker phenomenon may occur because the first frame period 1frame illustrated in FIG. 3 is repeated only once per second.

An exemplary embodiment of the present invention includes a method of individually controlling the frequencies of the first to fourth scan signals and the emission signals to prevent the flicker phenomenon potentially caused by low-frequency driving.

Figure 7:
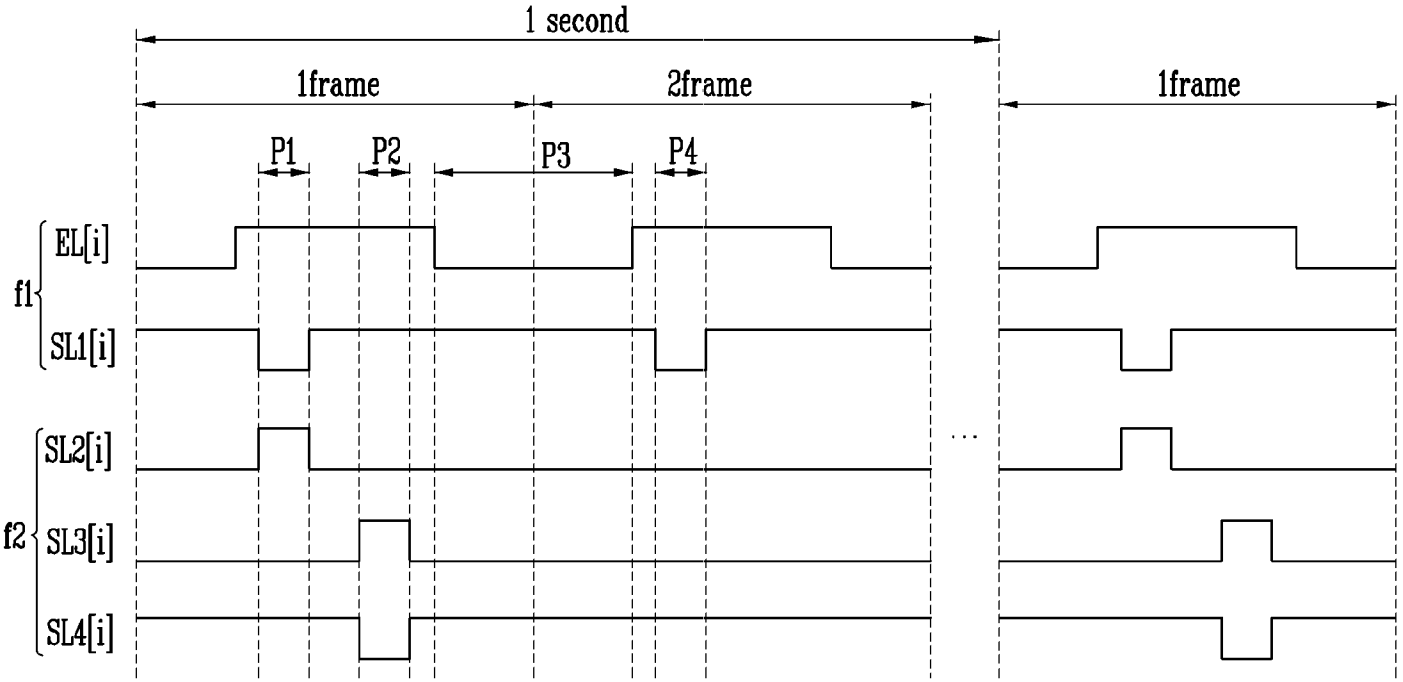
FIG. 7 is a graphical waveform diagram showing operations of a plurality of frame periods in the pixel according to FIG. 2.

FIG. 7 illustrates a waveform diagram showing operations of a plurality of frame periods in the pixel according to FIG. 2.

As illustrated in FIG. 1 and FIG. 2, according to an exemplary embodiment of the present invention, the transistors T1 to T6 constituting the pixel PX[i, j] may be turned on by receiving the first to fourth scan signals that are individually supplied from the first to fourth scan drivers 300, 310, 320, and 330. As a result, the frequencies of the first to fourth scan signals may be individually controlled, and low-frequency driving of the display device DD may be performed.

For example, the frequencies of the emission signal supplied through the emission control line EL[i] and the first scan signal supplied through the first scan line Sl1[i] may be the first frequency f1 determined independently of the driving frequency of the display device DD. For example, the first frequency f1 may be a maximum driving frequency (e.g., 120 Hz) of the display device DD, but the present invention is not limited thereto, and may be selectively determined in a range that is greater than or equal to a threshold frequency at which no flicker phenomenon occurs (e.g., 60 Hz). In this case, since the frequency of the emission signal may be the same as the frequency of the emission start signal, and the frequency of the first scan signal may be the same as the frequency of the first scan start signal, and thus the frequency of the emission start signal and the frequency of the first scan start signal may be the first frequency f1.

In addition, the frequencies of the second to fourth scan signals supplied through the second to fourth scan lines SL2[i], SL3[i], and SL4[i] may be a second frequency f2. Herein, the second frequency f2 may be the same as the driving frequency of the display device DD. More specifically, the second frequency f2, which is a frequency for low-frequency driving of the display device DD, may be less than the first frequency f1, and may, for example, be less than 60 Hz, 30 Hz or less, 10 Hz or less, or 1 Hz, without limitation thereto. In this case, since the frequencies of the second to fourth scan signals are the same as the frequencies of the second to fourth scan start signals, the frequencies of the second to fourth scan start signals to the second scan start signal may be the same as the second frequency f2.

As described above, when the frequency of the second to fourth scan signals is controlled to the second frequency f2 lower than the first frequency f1, and the frequency of the emission signal and the first scan signal is controlled to the first frequency f1, the first frame period 1frame described with reference to FIG. 3 may be repeated at a time interval corresponding to the second frequency f2. For example, when the second frequency f2 is 1 Hz, the first frame period 1frame may be repeated once every second, which is a time interval corresponding to the second frequency f2.

In addition, a second frame period 2frame in which the second to fourth scan signals are not supplied may be repeated at a time interval corresponding to the first frequency f1 within a time interval corresponding to the second frequency f2. For example, when the first frequency f1 is 120 Hz and the second frequency f2 is 1 Hz, the second frame period 2frame may be repeated 119 times or substantially once every 1/120 seconds, which is a time interval corresponding to the first frequency f1, within 1 second, which, in turn, is a time interval corresponding to the second frequency f2.

The second frame period 2frame may include the third period P3 described above and a fourth period P4. In the fourth period P4, the first scan signal of the low level may be supplied to the pixel PX[i, j] through the first scan line SL1[i]. Accordingly, in the pixel PX[i, j] of FIG. 2, the fifth transistor T5 may be turned on, and the first to fourth transistors T1 to T4 and the sixth transistor T6 may be turned off. That is, as the fifth transistor T5 is turned on, the first electrode (or the fourth node N4) of the emission element EL may be initialized into the initialization voltage Vint. Unlike the third period P3, the fourth period P4 may be a period in which the gate electrode of the driving transistor TD is not initialized.

That is, the second frame period 2frame may include the third period P3 in which the emission element EL emits light with luminance corresponding to the data signal, and the fourth period P4 for initializing the first electrode (or the fourth node N4) of the emission element EL.

As described above, in this exemplary embodiment of the present invention, even in the low-frequency driving, since the light emission of the emission element EL and the initialization of the emission element EL are performed at a frequency corresponding to the relatively high first frequency f1, the flicker phenomenon may be prevented. In addition, an effect of reducing power consumption due to the low-frequency driving may be obtained by compensating a threshold voltage a number of times that is smaller than the first frequency f1 and corresponds to the second frequency f2 corresponding to the low frequency, writing the data signal, and initializing the gate electrode of the driving transistor TD.

Figure 8:
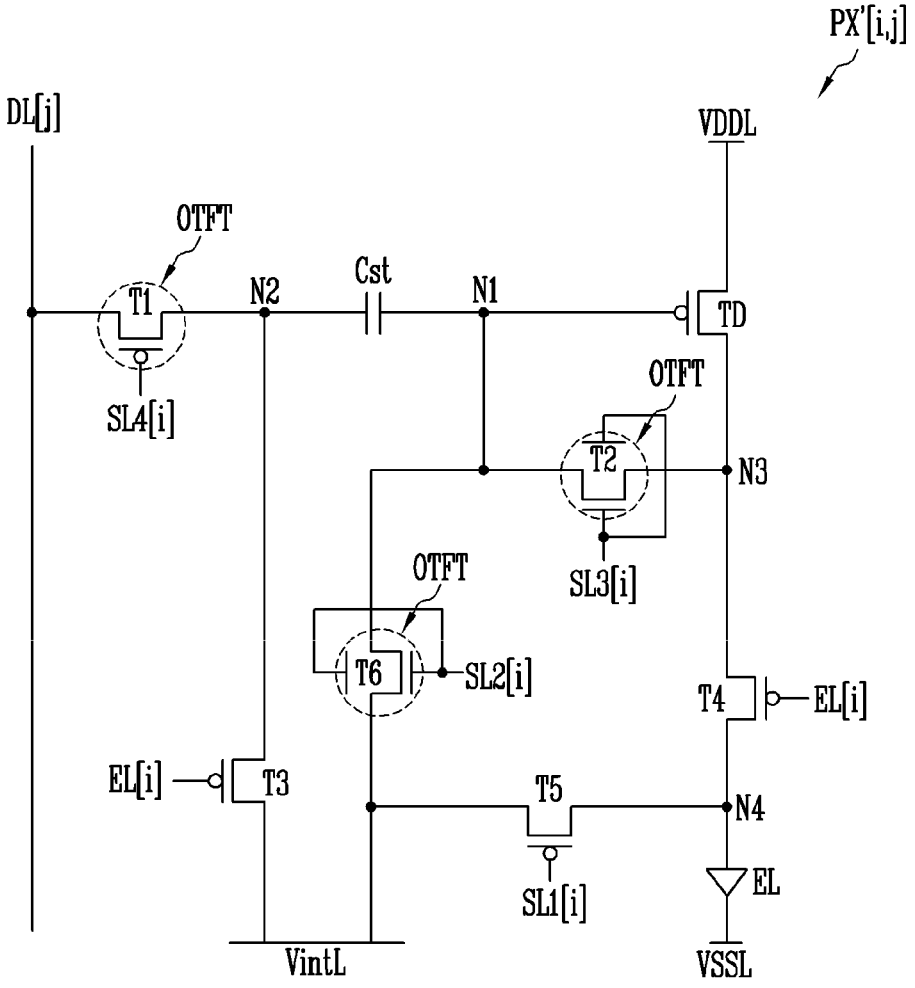
FIG. 8 is a circuit diagram illustrating an exemplary embodiment of the pixel according to FIG. 2.
Figure 9:
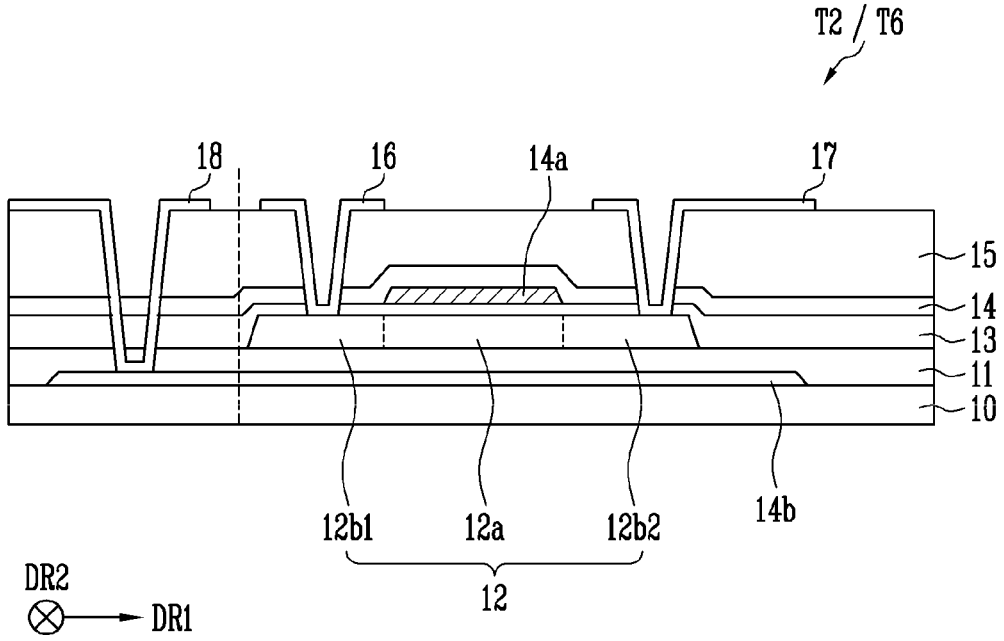
FIG. 9 is a cross-sectional diagram showing a dual gate transistor according to FIG. 8.

FIG. 8 illustrates an exemplary embodiment of a pixel according to FIG. 2. FIG. 9 illustrates a cross-sectional view showing a dual gate transistor according to FIG. 8.

Referring to FIG. 8, a pixel PX'[i, j] in which the pixel PX[i, j] according to FIG. 2 is modified is illustrated.

The pixel PX'[i, j] formed by replacing the second transistor T2 and the sixth transistor T6, which are oxide thin film transistors OTFT, with dual-gate transistors in the pixel PX[i, j] according to FIG. 2.

When the second transistor T2 and the sixth transistor T6 are dual-gate transistors, such as the pixel PX'[i, j] illustrated in FIG. 8, the second scan signal and the third scan signal may be supplied through the two gate electrodes, thereby improving a gate turn-on response speed and obtaining a light blocking effect.

For example, the second transistor T2 may be rapidly turned on by receiving the third scan signal through the third scan line SL3[i] commonly connected to the two gate electrodes. In addition, the sixth transistor T6 may be rapidly turned on by receiving the second scan signal through the second scan line SL2[i] commonly connected to the two gate electrodes.

Accordingly, it is possible to prevent response speed deterioration or the like in an embodiment in which the second transistor T2 and the sixth transistor T6 are implemented by using oxide thin film transistors OTFT, such as those having a polysilicon semiconductor layer formed through an LTPS process.

Referring to FIG. 9, a cross-sectional view is illustrated that may commonly apply to the second transistor T2 and/or the sixth transistor T6. In FIG. 9, a first direction DR1 may be a direction from the first electrode to the second electrode of the second transistor T2 or the sixth transistor T6. A second direction DR2 may belong to a same plane as the first direction DR1, and may be a direction that is perpendicular to the first direction DR1.

The second transistor T2 and/or the sixth transistor T6 may include a bottom gate electrode 14*b* disposed on a first side surface of base layer 10; an active layer pattern 12 including a channel region 12*a* that is spaced from the bottom gate electrode 14*b* with a first insulating film 11 therebetween to form a channel, a first region 12*b*1 and a second region 12*b*2 disposed at opposite sides of the channel region 12*a*; a top gate electrode 14*a* spaced apart from the active layer pattern 12 with a second insulating film 13 therebetween to overlap the channel region 12*a* and the active layer pattern 12; a first electrode 16 and a second electrode 17 spaced apart from each other on the active layer pattern 12 with the second insulating film 13, a third insulating film 14, and a fourth insulating film 15 therebetween, with the first and second electrodes 16 and 17 connected to the first region 12*b*1 and the second region 12*b*2 of the active layer pattern 12, respectively. The active layer pattern 12 may include the oxide semiconductor described above.

In FIG. 9, the base layer 10 may be a substrate of the display device DD or a buffer layer on the substrate. The bottom gate electrode 14*b* and the top gate electrode 14*a* may be electrically connected to each other through a contact hole. For example, the bottom gate electrode 14*b* may be connected to the top gate electrode 14*a* through at least a conductive pattern 18, and may be connected to the second scan line SL2[i] (for the sixth transistor T6) or the third scan line SL3[i] (for the second transistor T2) through the conductive pattern 18.

One of the first region 12*b*1 and the second region 12*b*2 may be a source region, and the other may be a drain region. For example, when the first region 12*b*1 is the source region, the second region 12*b*2 may be the drain region. Conversely, when the first region 12*b*1 is the drain region, the second region 12*b*2 may be the source region. This may vary depending on a carrier type (e.g., N type or P type) and a direction of the current.

When the dual-gate transistor according to FIG. 9 is used as the second transistor T2, the first electrode 16 of the second transistor T2 may be connected to the third node N3, and the second electrode 17 of the second transistor T2 may be connected to the first node N1. In addition, the top gate electrode 14*a* and the bottom gate electrode 14*b* of the second transistor T2 may be commonly connected to the third scan line SL3[i].

When the dual-gate transistor according to FIG. 9 is used as the sixth transistor T6, the first electrode 16 of the sixth transistor T6 may be connected to the first node N1, and the second electrode 17 of the sixth transistor T6 may be connected to the initialization line VintL. In addition, the top gate electrode 14*a* and the bottom gate electrode 14*b* of the sixth transistor T6 may be commonly connected to the second scan line SL2[i].

Figure 10:
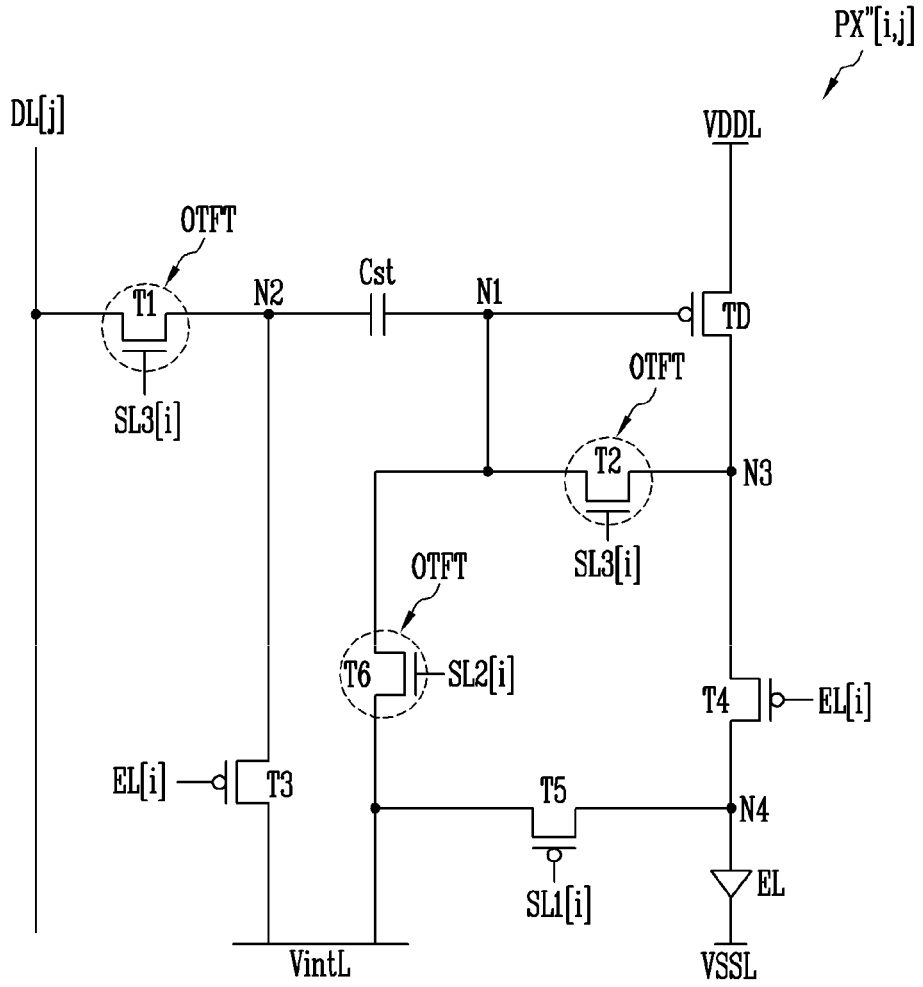
FIG. 10 is a circuit diagram illustrating an exemplary embodiment of the pixel according to FIG. 2.
Figure 11:
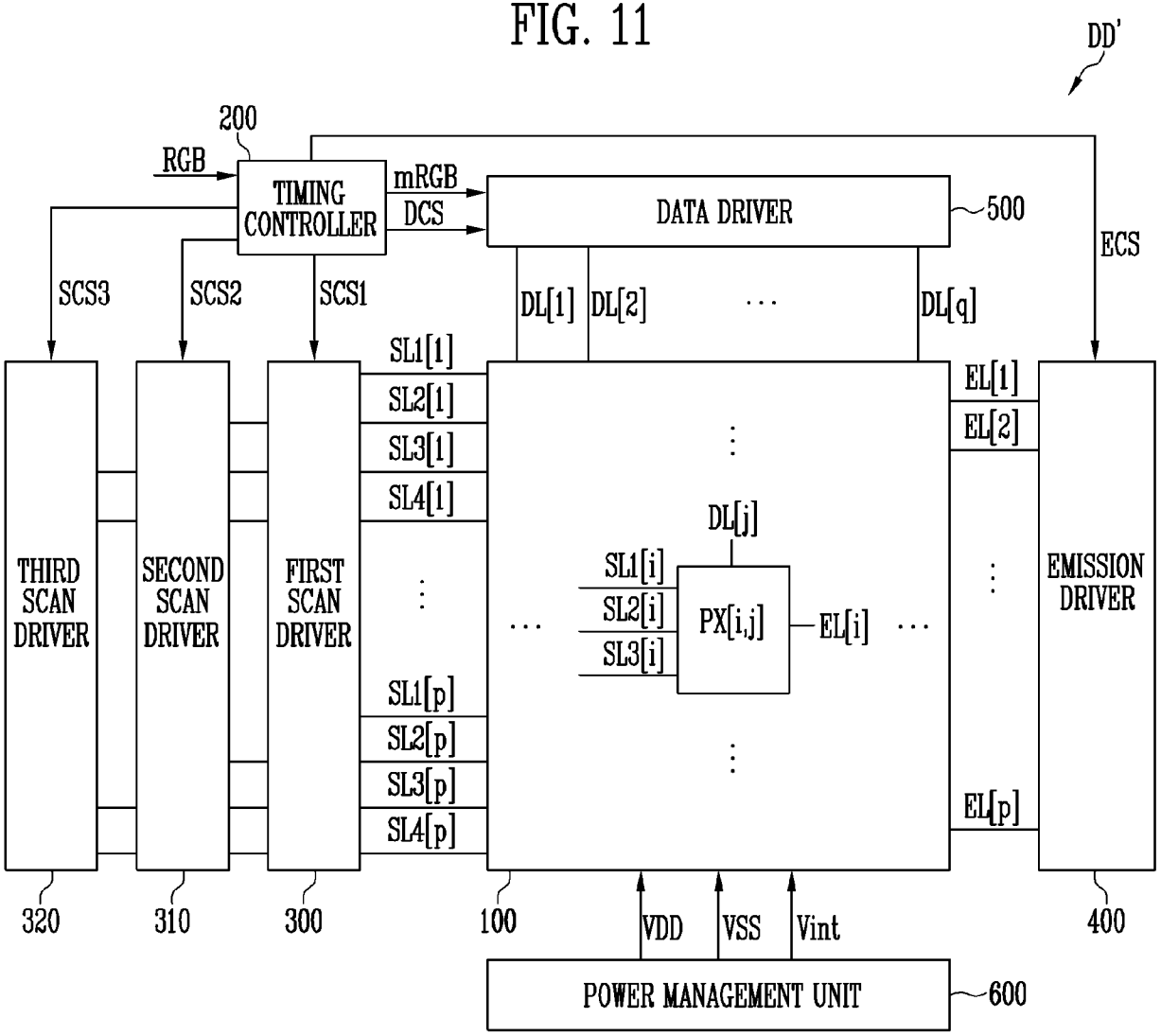
FIG. 11 is a schematic block diagram illustrating a display device including the pixel according to FIG. 10.

FIG. 10 illustrates an exemplary embodiment of a pixel according to FIG. 2. FIG. 11 illustrates a display device including the pixel according to FIG. 10.

In the pixel PX[i, j] according to FIG. 2, the fifth transistor T5, the sixth transistor T6, the second transistor T2, and the first transistor T1 are each turned on independently by using the first to fourth scan signals supplied through the first to fourth scan lines SL1[i], SL2[i], SL3[i], and SL4[i].

The pixel PX[i, j] shown in FIG. 2 may be configured for differently controlling the frequencies of the first to fourth scan signals that turn on the transistors, but where a plurality of independent scan driving units 300, 310, 320, and 330 are used, it may occupy a lot of circuit area as illustrated in FIG. 1.

A pixel PX"[i, j] may be formed by replacing the first transistor T1 with an n-type transistor, and connecting the third scan line SL3[i] to the gate electrode of the first transistor T1 in the pixel PX[i, j] illustrated in FIG. 2. Duplicate description may be omitted.

When the pixel PX"[i, j] illustrated in FIG. 10 is used, the first transistor T1 may be turned on by a third scan signal of a high level supplied through the third scan line SL3[i].

In this case, the third scan line SL3[i] is the same as the third scan line SL3[i] connected to the gate electrode of the second transistor T2 in FIG. 2. Accordingly, the fourth scan signal through the fourth scan line SL4[i] may be replaced by the third scan signal supplied through the third scan line SL3[i], and thus the fourth scan driver 330 illustrated in FIG. 1 may be omitted.

FIG. 11 illustrates a display device DD' in which the fourth scan driver 330 is replaced with the third scan driver 320, and the fourth scan driver 330 is omitted in the display device DD according to FIG. 1. Duplicate description may be omitted.

Referring to FIG. 11, since the fourth scan driver 330 may be omitted in the display device DD' according to FIG. 10 versus the display device DD according to FIG. 1, a circuit area for implementing the scan drivers (300, 310, and 320) may be reduced.

While exemplary embodiments of the present invention have been particularly shown and described with reference to the accompanying drawings, the specific terms used herein are only for the purpose of describing the invention by way of example and are not intended to define the meanings thereof or be limiting of the scope of the invention set forth in the claims. Therefore, those of ordinary skill in the pertinent art will understand that various modifications and other equivalent embodiments of the present invention are possible. Consequently, the true technical protective scope of the present invention must be determined based on the technical spirit of the appended claims.

What is claimed is:

1. A display device comprising:

a pixel;

an emission driver configured to supply an emission signal to an emission control line connected to the pixel;

scan drivers configured to supply scan signals to scan lines connected to the pixel; and a data driver configured to supply a data signal to a data line connected to the pixel, wherein the emission signal and at least one of the scan signals are output at a first frequency in a low-frequency driving, wherein at least another of the scan signals is output at a second frequency that is the same as a driving frequency in the low-frequency driving, and the second frequency is different from the first frequency in the low-frequency driving.

2. The display device of claim 1, wherein the first frequency is constant regardless of a change in the driving frequency in the low-frequency driving.

3. The display device of claim 2, wherein the first frequency is greater than the driving frequency in the low-frequency driving.

4. The display device of claim 3, wherein each of the second transistor and the sixth transistor are a dual-gate transistor including an active layer pattern, a top gate electrode disposed at an upper portion of the active layer pattern, and a bottom gate electrode disposed at a lower portion of the active layer pattern.

5. The display device of claim 3, wherein:

each of the first transistor, the third transistor, the fourth transistor, and the fifth transistor is a P-type transistor; and each of the second transistor and the sixth transistor is an N-type transistor.

6. The display device of claim 3, wherein:

each of the first transistor, the second transistor, and the sixth transistor is a N-type transistor; and each of the third transistor, the fourth transistor, and the fifth transistor is a P-type transistor.

7. The display device of claim 6, wherein the first transistor includes a gate electrode connected to the third scan line instead of the fourth scan line to receive the third scan signal.

8. The display device of claim 2, wherein the pixel comprises:

a driving transistor connected between a first power line and a third node, the driving transistor including a gate electrode connected to a first node;

a first transistor between the data line and a second node, the first transistor including a gate electrode connected to a fourth scan line supplying a fourth scan signal;

a second transistor connected between the first node and the third node, the first transistor including a gate electrode connected to a third scan line supplying a third scan signal;

a third transistor connected between the second node and an initialization line, the third transistor including a gate electrode connected to the emission control line supplying the emission signal;

a fourth transistor connected between the third node and a fourth node, the fourth transistor including a gate electrode connected to the emission control line supplying the emission signal;

a fifth transistor connected between the initialization line and the fourth node, the fifth transistor including a gate electrode connected to a first scan line supplying a first scan signal;

a sixth transistor connected between the first node and the initialization line, the sixth transistor including a gate electrode connected to a second scan line supplying a second scan signal;

a storage capacitor connected between the second node and the first node; and a light-emitting element connected between the fourth node and a second power line.

9. The display device of claim 8, wherein each of the second transistor and the sixth transistor is an oxide thin film transistor including an oxide semiconductor layer.

10. The display device of claim 9, wherein the first transistor is the oxide thin film transistor.

11. The display device of claim 8, wherein the first scan signal is output at the first frequency.

12. The display device of claim 11, wherein the second scan signal, the third scan signal, and the fourth scan signal are output at the second frequency.

13. The display device of claim 12, wherein the pixel repeats a first frame period at a time interval corresponding to the second frequency.

14. The display device of claim 13, wherein the first frame period includes:

a first period for initializing the pixel;

a second period for compensating a threshold voltage of the driving transistor and writing the data signal to the pixel; and a third period during which the light-emitting element emits light with a luminance corresponding to the data signal.

15. The display device of claim 14, wherein:

in the first period, the first scan signal is supplied to the first scan line, and the second scan signal is supplied to the second scan line;

in the second period, the third scan signal is supplied to the third scan line, and the fourth scan signal is supplied to the fourth scan line; and in the third period, the emission signal is supplied to the emission control line.

16. The display device of claim 14, wherein the pixel repeats a second frame period at a time interval corresponding to the first frequency.

17. The display device of claim 16, wherein the second frame period includes the third period and a fourth period for initializing a first electrode of the light-emitting element.

18. The display device of claim 17, wherein, in the fourth period, the first scan signal is supplied to the first scan line.

* * * * *